US006240261B1

(12) United States Patent
Tomidokoro

(10) Patent No.: US 6,240,261 B1
(45) Date of Patent: May 29, 2001

(54) SYSTEM AND METHOD FOR AVOIDING AN ERRONEOUS SERVICE PERSON CALL

(75) Inventor: Nobuaki Tomidokoro, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/408,511

(22) Filed: Sep. 30, 1999

(30) Foreign Application Priority Data

Oct. 1, 1998 (JP) ..... 10-280072
Sep. 16, 1999 (JP) ..... 11-262698

(51) Int. Cl.[7] ..... G03G 15/00
(52) U.S. Cl. ..... 399/8; 399/43
(58) Field of Search ..... 399/8, 9, 11, 16, 399/18, 21, 43

(56) References Cited

U.S. PATENT DOCUMENTS 5,835,816 * 11/1998 Sawada et al. ..... 399/8
5,848,326 12/1998 Komuro et al. .
5,911,092 * 6/1999 Hotta et al. ..... 399/21

* cited by examiner

*Primary Examiner*—Quana M. Grainger
(74) *Attorney, Agent, or Firm*—Oblon, Spivak, McClelland, Maier & Neustadt, P.C.

(57) ABSTRACT

An image forming apparatus supervising system includes a problem detecting device in each of image forming apparatuses, which detects a problem to be reported to a central control apparatus as a service person call when the problem occurs in the image forming apparatus. A first copysheet number storing device is employed to store a total number of copysheets having been copied before a current occurrence of the problem occurs in an image forming apparatus. A second copysheet number storing device is also employed to store a number of copysheets having been copied before a last occurrence of the problem. The problem is reported only when a difference between the numbers of copysheets stored in the first copysheet number storing device and the second copysheet number storing device exceeds a predetermined level so that an erroneously detected problem can be avoided from being reported as the service person call.

11 Claims, 15 Drawing Sheets

Image Forming Apparatus Supervising System

Image Forming Apparatus Supervising System

Data Communication Apparatus

Image Forming Apparatus (Copier)

Text Data Communicated between CCA & DCA

Fig. 7

| CODE | PROCESS NAME | CONTENTS |
|---|---|---|
| 30 | SC Call | Auto Call When a SC Occurs |
| 31 | Manual Call | Auto Call When a Manual Switch is Depressed |
| 32 | Alarm Sending | Auto Alarm Call |
| 22 | Block Billing Process | Auto Call When Block Billing Number has been Counted up |
| 02 | Data Reading | Read Data Stored in a PPC |
| 04 | Data Writing | Write Data Stored in a PPC |
| 03 | Execution | Execute Test or the like under Remote Control |
| 08 | Device Code Confirmation | Process for Communication Check |

Table of Distinction Code

Fig. 8

| CODE | Data Length | CONTENTS |
|---|---|---|
| Information Code | 11 | Represents kind of specific information |
| Digit Number of Data Portion | 2 | Represents data length of following data portion by ASCII code (00:no data portion) |
| Data Portion | Changeable Length | Data indicative of contents of each information code (no field, if digit Number of data portion is 00) |

Table of Information Record

Text Data Communicated between DCA & P/I

Fig. 10

Text Data Communicated between P/I & Copier

Fig. 14

| SC Number | Name | Detecting Condition |
|---|---|---|
| 101 | Drum Potential EX Ceeding | Drum Surface Potential ≧ 1500V, 3 Second Continue |
| 102 | Drum Potential Shortage | Drum Surface Potential ≦ 700V, 6 Second Continue |
| 201 | High Fixing Temperature | Fixing Temperature ≧ 250°C, 0.5 Second Continue |
| ⋮ | ⋮ | ⋮ |

SC Generating Condition

Fig. 15

| SC Number | SC Call Interval |
|---|---|
| 101 | 5 |
| 102 | 10 |
| 201 | 0 |
| . | . |
| . | . |

Table of SC Call Interval

SYSTEM AND METHOD FOR AVOIDING AN ERRONEOUS SERVICE PERSON CALL

BACKGROUND OF THE INVENTION

1. Field of the Invention

This invention relates to an image forming apparatus supervising system having a central control apparatus and a plurality of image forming apparatuses, such as copiers, facsimiles, printers, etc. connected to the central control apparatus via a communication network. More particularly, this invention relates to an image forming apparatus supervising system capable of avoiding an erroneous service person call from a user site to a service center or the like.

2. Discussion of the Background

A variety of image forming apparatus supervising systems have been proposed. For example, the Japanese Patent Application laid Open No. 8-1116399 describes an image forming apparatus disposed at a user site connected to a data communication apparatus via a signal line. Further, Japanese Patent Application laid Open No. 5-141526 describes that information related to a paper jam occurring in the image forming apparatus is automatically transmitted by an image forming apparatus supervising system, if it is determined that the paper jam requires maintenance of a service person. Thus, the service person can call on the user and address a problem (the paper jam) quickly.

Further, the Japanese Patent Application Laid Open No. 8-331355 describes that information of a time when maintenance for an image forming apparatus of a user starts, and a time when the same is completed, are reported from the user site using an image forming apparatus supervising system.

Further, a digital type image forming apparatus having a printer function, a facsimile function, and a copier function is generally used as an output device of a host computer as the digital type image forming apparatus comes into wide use. Further, a scanner used in the copier function is generally used as an input device of the host computer.

As a developed system, a plurality of digital image forming apparatuses disposed at user sites are connected to a host computer (central control apparatus) disposed at a sales dealer or a service center via a data communication apparatus and a data communication line.

Further, it is well known that the plurality of image forming apparatuses disposed at user sites are supervised by a central control apparatus (host machine-supervising apparatus) using a remote diagnosis system and a public telephone line or the like.

The background system generally includes the following functions. First, the system may control data communications between the central control apparatus and the plurality of the image forming apparatuses. Second, the system may control data communications between the image forming apparatuses and the central control apparatus or a data communication apparatus. Third, the system may control the data communication apparatus.

In such a background image forming apparatus supervising system, predetermined problems occurring in an image forming apparatus (hereinafter sometimes referred to as a SC (service call)) are quickly reported to the central control apparatus from the image forming apparatuses via the communication line as a service person call.

However, sometimes a user can resolve the problem by turning an electrical switch of the image forming apparatus having the problem OFF and ON, and then perform an image formation without any problem, if the SC has erroneously been detected by the image forming apparatus. Such an erroneous detection is generally executed when a sensor is wrongly tripped due to noise or the like.

Further, since a central control apparatus having been informed of a problem generally arranges a service person to call on a user having the reported problem, the arrangement may result in waste, if the SC was erroneously detected and reported to the central control apparatus.

SUMMARY OF THE INVENTION

Accordingly, an object of the present invention is to provide a novel supervising system and method for image forming apparatuses.

These and other object are achieved by the supervising system including a problem detecting device for detecting a present problem occurring in an image forming apparatus, a first copysheet number storing device for storing a total number of copysheets copied before the present problem occurred in the image forming apparatus, and a second copysheet number storing device for storing a number of copysheets having been copied before a last problem occurred in the image forming apparatus. The problem may be reported only if a difference between the number stored in the first copysheet number storing device and the number stored in the second copysheet number storing device exceeds a predetermined level.

In another embodiment, the number of total copysheets stored in the first copysheet number storing device is copied to the second copysheet number storing device when the present problem occurs.

In yet another embodiment, the level is predetermined corresponding to the kind of the problem.

In yet another embodiment, the level is changeable.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 7 is a chart that illustrates an example of a table of a data distinction code included in the text data illustrated in FIG. 6;

FIG. 8 is a chart that illustrates an example of a table of an information record included in the text data illustrated in FIG. 6;

FIG. 10 is a chart that illustrates an example of a structure of text data to be communicated between the personal interface and the control section of the image forming apparatus illustrated in FIGS. 1 and 4;

FIG. 14 is a chart that illustrates a SC table showing relations among a SC number, a name of the SC number, and a problem detecting condition for generating a SC; and FIG. 15 is a chart that illustrates a SC interval table showing a relation between the SC number and a SC interval.

PREFERRED EMBODIMENTS OF THE PRESENT INVENTION

Figure 1:
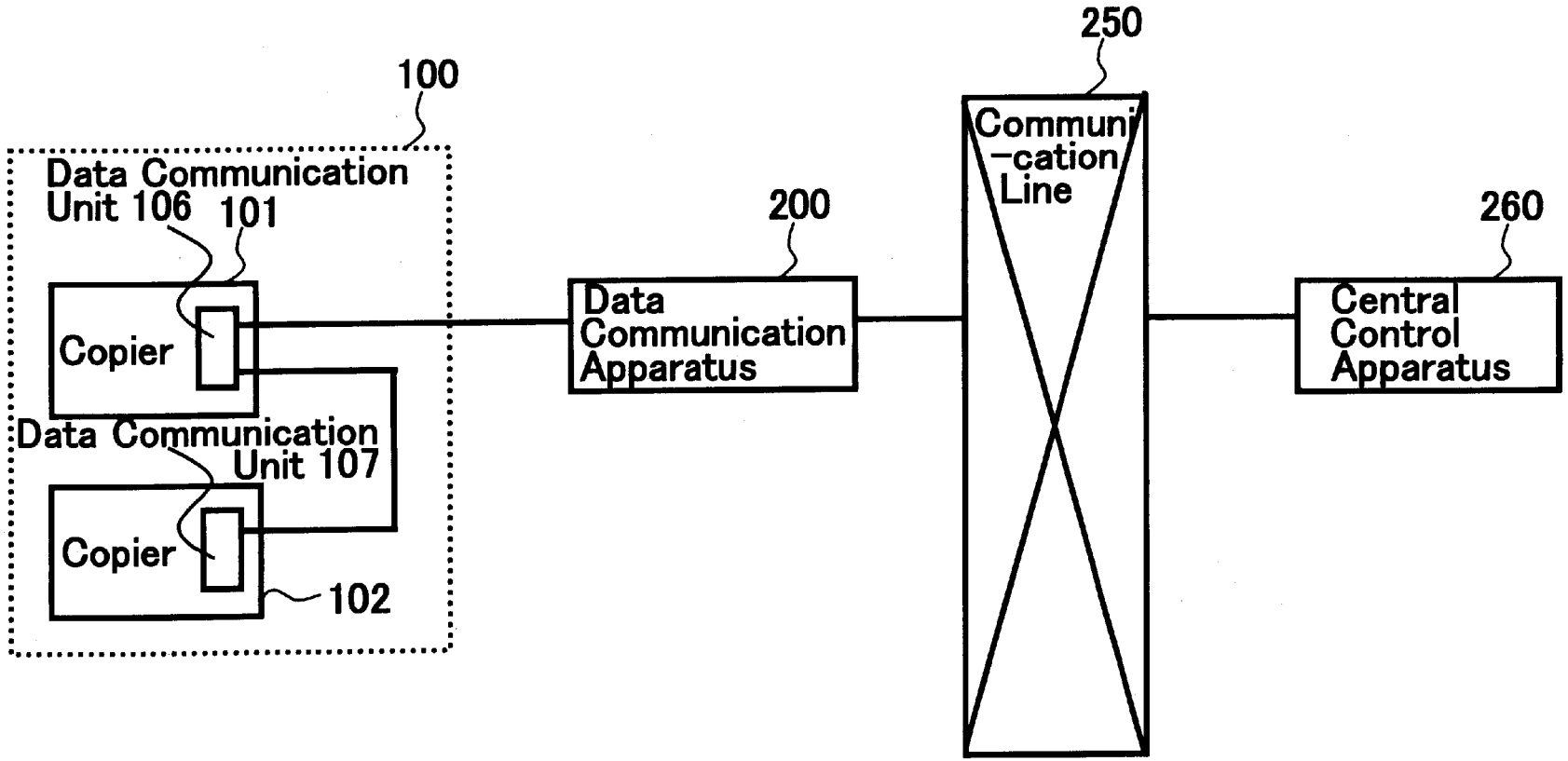
FIG. 1 is a block chart that illustrates an example of an overall structure of an image forming apparatus supervising system of the present invention.

Embodiments of the present invention are now explained referring to the several figures, wherein like reference numerals designate identical or corresponding parts throughout the several views.

First, an image forming apparatus supervising system of the present invention is illustrated in FIG. 1 using a block chart. As illustrated therein, the image forming apparatus supervising system may include a group 100 of image forming apparatuses 101 and 102, a data communication apparatus 200 (hereinafter sometimes referred to as a DCA 200), and a communication line 250.

Further, a central control apparatus 260 (hereinafter sometimes referred to as a CCA 260) may be included therein.

The data communication apparatus 200 may be connected to the communication line 250, and transfer text data transmitted from the central control apparatus 260 to the image forming apparatuses 101–102. The data communication apparatus 200 may also transfer data generated by the image forming apparatuses 101–102 to the central control apparatus 260 through the communication line 250. The data communication apparatus 200 can be operable all day. Thus, data communications between the central control apparatus 260 and the image forming apparatus group 100 can be executed even during a time when electrical power for the image forming apparatus group 100 is turned OFF.

Each image forming apparatus 101–102 and the data communication apparatus 200 are connected in a state of a so-called multi-drop connection as illustrated in FIG. 1. Further, data communications between the image forming apparatuses 101 and 102 and the data communication apparatus 200 can be executed using a serial port in accordance with a data communication standard of RS485 recommended by the electronic industries association (EIA). The data communications between the image forming apparatuses 101 and 102 and the data communication apparatus 200 may be executed during polling. In the polling, each image forming apparatus may be determined if data to be transmitted to the data communication apparatus 200 exists therein in turn, and data may be transferred therefrom to the data communication apparatus 200 in a state of text data if the data exists therein.

Figure 2:
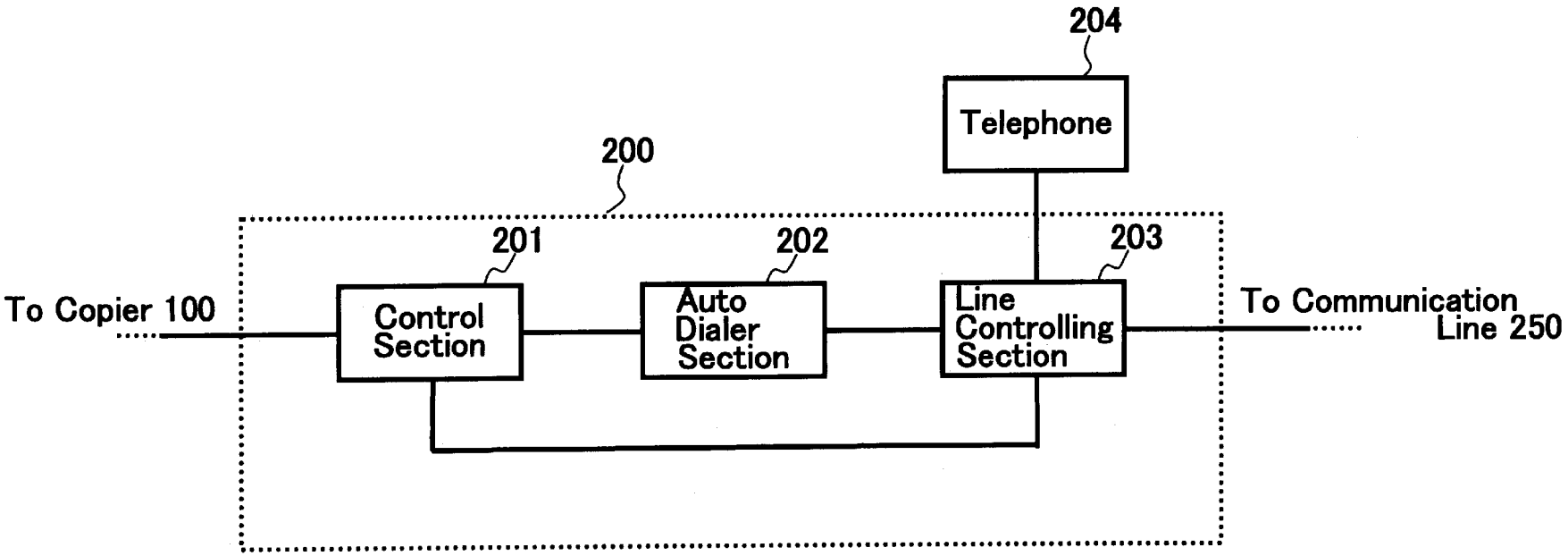
FIG. 2 is a block chart that illustrates an example of a structure of a data communication apparatus illustrated in FIG. 1.

The data communication apparatus 200 is illustrated in FIG. 2 using a block chart. As illustrated therein, the data communication apparatus 200 may include a control section 201, an auto-dialer section 202 for automatically dialing a number of the central control apparatus 260, and a line controlling section 203 for selectively connecting the communication line 250 with the image forming apparatuses 101–102 or a telephone 204.

Figure 4:
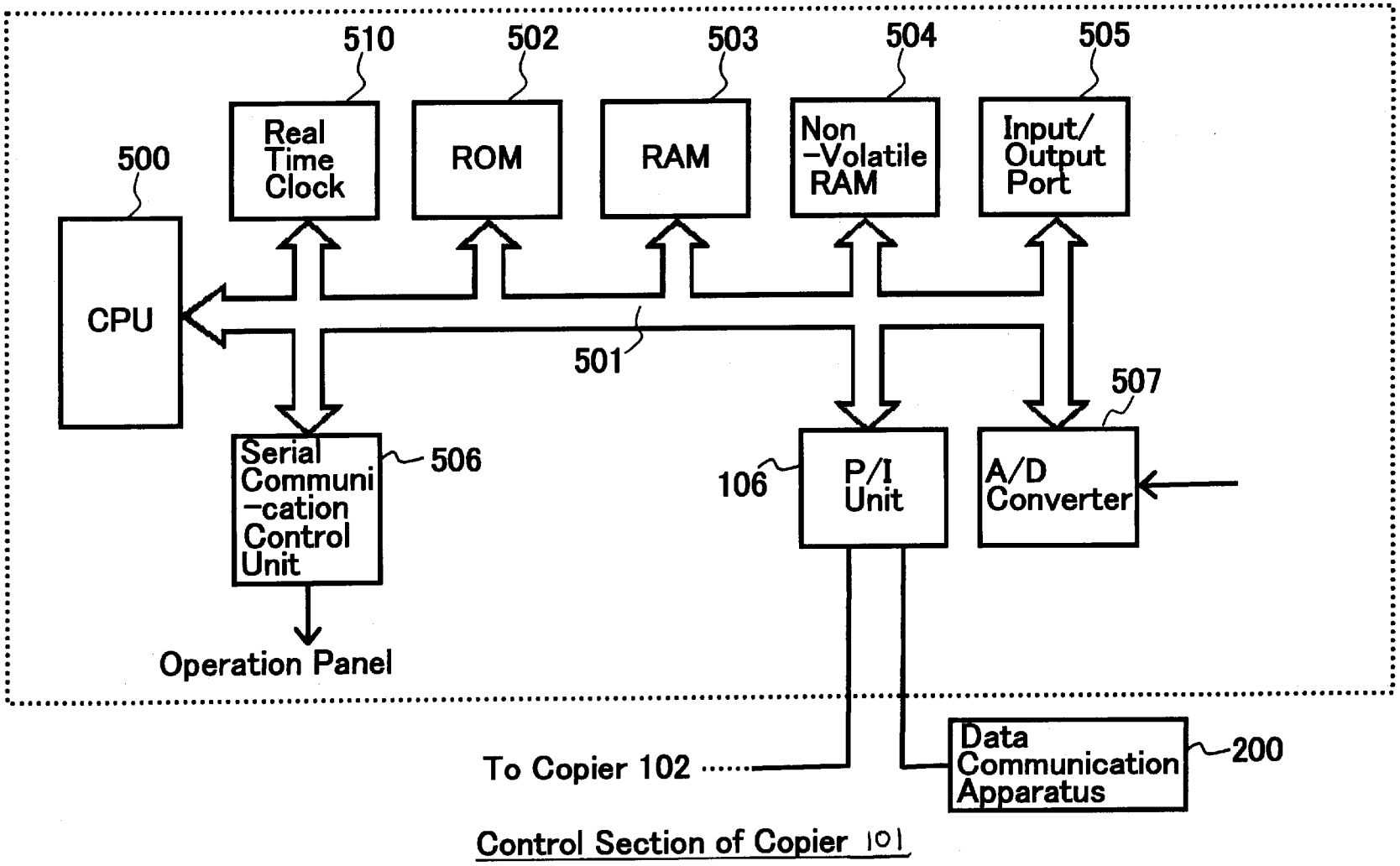
FIG. 4 is a block chart that illustrates an example of a structure of a control section of each image forming apparatus illustrated in FIG. 3.

The control section 201 has substantially the same structure as control devices of the image forming apparatuses 101–102 as illustrated in FIG. 4, as discussed further below. Namely, the control section 201 may include a ROM (read only memory) for storing control programs, a CPU (central processing unit) for executing the programs by reading them from the ROM, and a RAM (random access memory) for tentatively storing data. Further, a non-volatile RAM (random access memory) backed up by a battery, a serial communication unit, an I/O (input and output) port, and a real time clock for providing a present time data, and so on, are also provided therein. The non-volatile RAM may store communication data to be communicated between the central control apparatus 260 and the image forming apparatuses 101–102. The communication data may include a plurality of device codes, a plurality of ID codes for identifying one of the image forming apparatuses 101, 102, and a telephone number of the central control apparatus 260. Further, data relating to a number of times to execute a recall by the data communication apparatus 200 in a case of a communication error occurring between the data communication apparatus 200 and the central control apparatus 260, data relating to a number of retransmitting times, and an interval of the calls may also be included therein.

Figure 3:
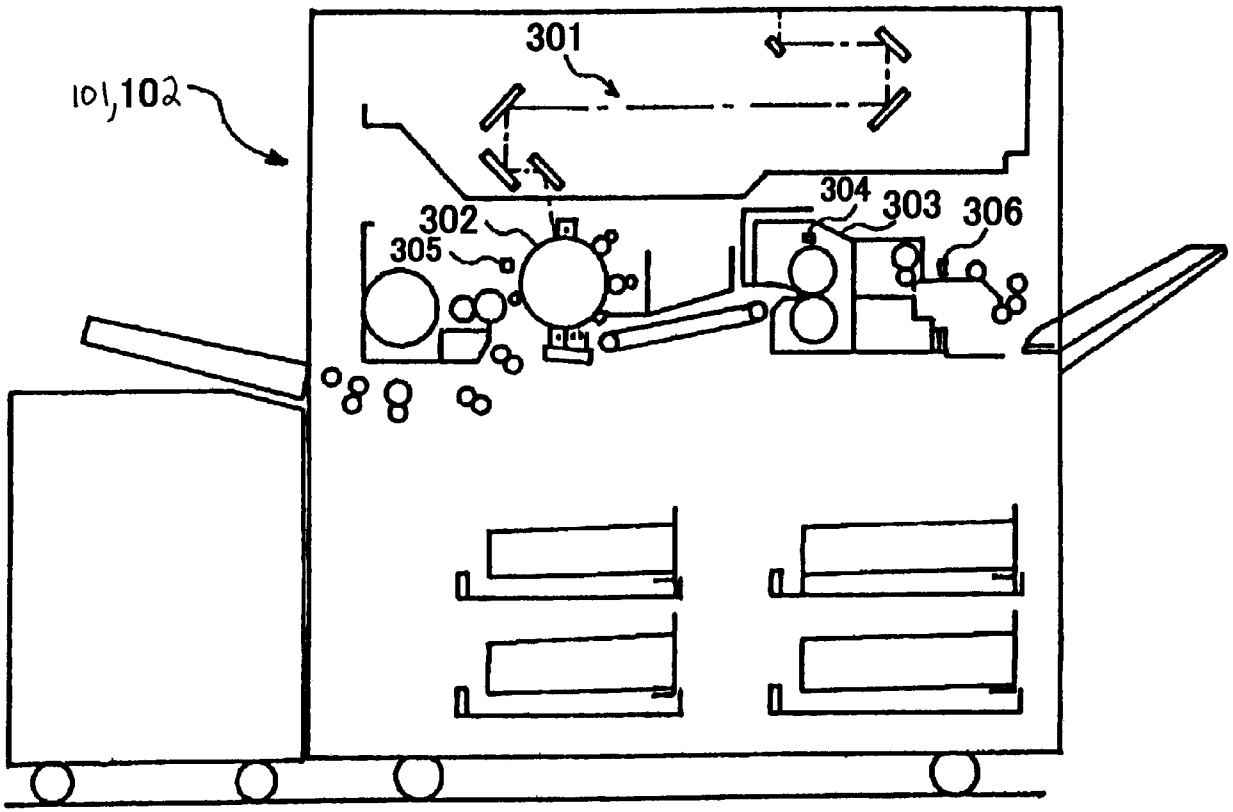
FIG. 3 is a schematic cross-sectional view of an image forming apparatus illustrated in FIG. 1

A structure of a copier as an image forming apparatus 101, 102 is now explained referring to FIG. 3.

The copier 101, 102 may be an analog type where a surface of a photo-conductive drum 302 is exposed with an optical original image read by a scanner 301 to form an electrostatic latent image thereon. A charger for applying charge onto the surface of the photo-conductive drum 302, a developing unit for developing the latent image, and a transfer charger for separating a copysheet from the photo-conductive surface by applying charge thereto are arranged around the surface of the photo-conductive drum 302.

Further, a cleaning unit for cleaning the photoconductive surface after separating the copysheet may also be arranged therearound. A fixing unit 303 for fixing a toner image onto the copysheet and a sheet feeding mechanism are also provided in the image forming apparatus. A fixing thermistor 304 for detecting a peripheral temperature of a fixing roller, a peripheral electrical potential sensor 305 for detecting a potential of the photo-conductive drum 302, and a sheet ejection sensor 306 for detecting the copysheet ejected from the fixing unit 303 are also provided therein.

Since each device is well known, detailed explanations thereof are omitted here.

A control device of the copier 101 is now explained referring to FIG. 4. As illustrated therein, the control device may include a CPU 500 (central processing unit 500) for executing copying control programs having an address and some data, a control bus 501, and a ROM (read only memory) 502 connected to the CPU 500 through the bus 501 for storing control programs. Further, a RAM (random access memory) 503 for tentatively storing data, and a non-volatile RAM (random access memory) 504 for keeping data even when an electrical power source for the copier is turned OFF are included therein.

The control device may further include an I/O port 505 connected to the CPU 500 through the bus 501 for communicating data with the data communication apparatus 200. The I/O port 505 may also be connected to a plurality of loads, for example a driving motor, solenoids, a clutch, sensors, and so on (not shown), used in the image forming apparatuses 101–102. The control device may further include a serial communication control unit 506 for transmitting and receiving a signal from and to an operation display, a document feeding section, and a post processing section of the image forming apparatus 101. Explanations for the operation display, the document feeding section, and the post processing sections (each of which is not shown) are omitted here, because they are not new.

The control device may further include a personal interface (hereinafter referred to as a P/I) unit 106 disposed between the CPU 500 and the data communication apparatus 200. The P/I unit 106 may reduce the amount of work executed by the CPU 500. However, the P/I unit 106 may be omitted if the CPU 500 has a sufficient ability to perform the tasks of the P/I unit 106. The P/I unit 106 may perform the below described various functions.

First, the P/I unit 106 performs tasks of monitoring the polling and selecting operations executed by the data communication apparatus 200, transmitting either a positive or a negative response when the selecting operation is executed, and determining if a data communicated between the data communication apparatus 200 and the image forming apparatus 101 is correct. Further, the P/I unit 106 may execute a parity check of a frame transmitted from the data communication apparatus 200, request a re-transmitting of the data to be transmitted when an error occurs in the data communication, and detect a header portion of the frame before transmitting thereof. A real time clock 510 may be connected to the CPU 500 through the bus 501, so that the CPU 500 links its operation in real time by reading the real time clock 510.

The system bus 501 may include an address bus, a control bus, and a data bus. The bus 501 may be connected to the CPU 500, the real time clock 510, the ROM 502, and the RAM 503 so that data communications are possible therebetween in both directions. Further, the non-volatile RAM 504, the input/output port 505, the serial communication control unit 506, and the P/I unit 106 may also be connected to the bus 501 in a same manner as mentioned above.

A total copy counter (not shown) is provided in each image forming apparatus 101–102. The total copy counter may count a number of copysheet passed through the sheet ejection sensor 306 disposed downstream of the fixing unit 303 as illustrated in FIG. 3. The number may be stored in the RAM 504 disposed in each image forming apparatus as a first copysheet number storing device. The RAM 504 may function as a second copysheet number storing device as mentioned later. Thus, the total copy counter may indicate a number of total copy count values and a number of SC copy count values.

Further, the above-mentioned SC may be detected by the thermistor 304 when a temperature exceeds a prescribed allowable range, when the drum peripheral potential sensor 305 detects that a potential of the periphery of the drum is not within a prescribed range, etc., as examples.

Figure 5:
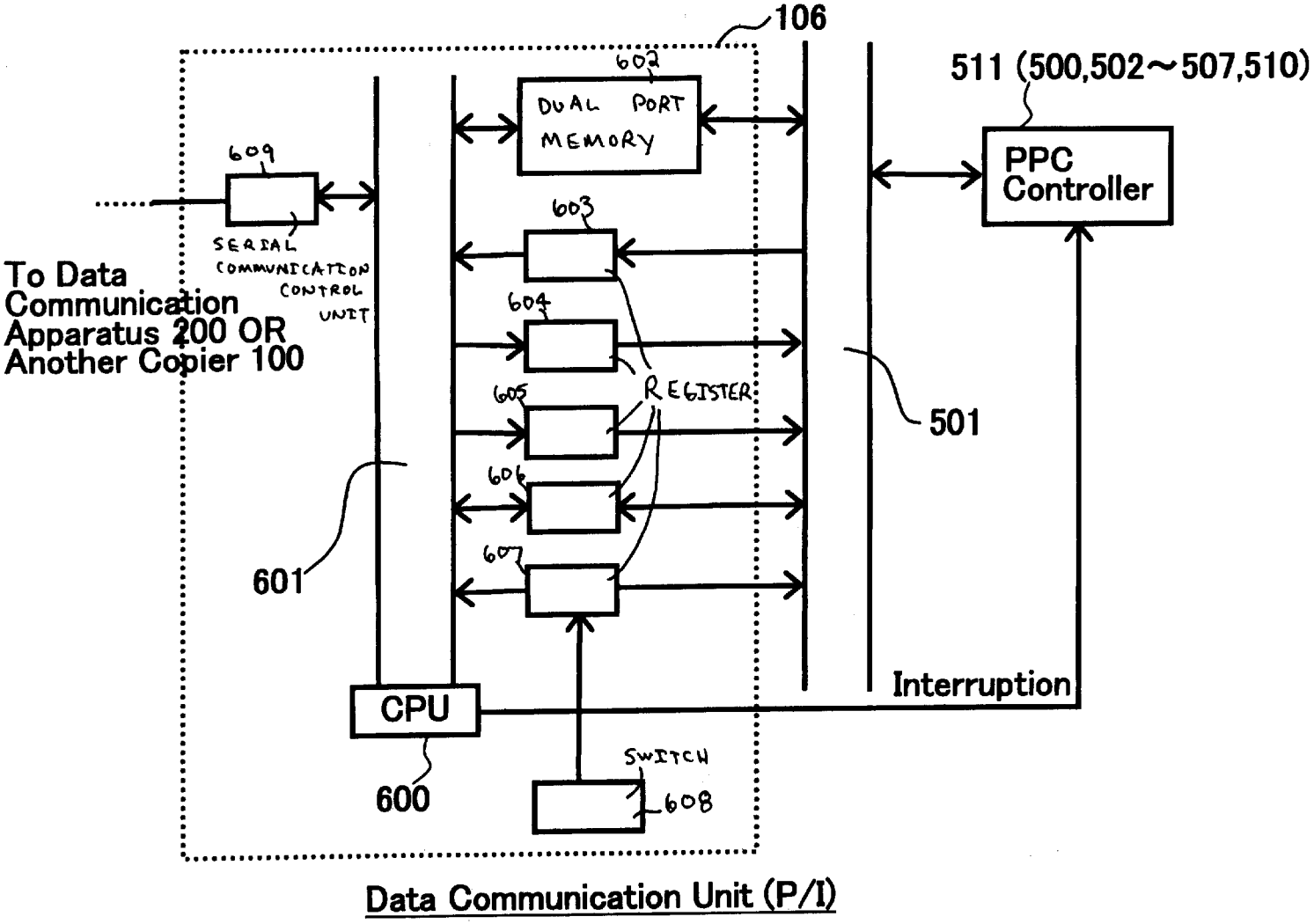
FIG. 5 is a block chart that illustrates an example of a structure of a personal interface included in each image forming apparatus illustrated in FIG. 3.

A constitution of the P/I unit 106 is illustrated in FIG. 5 in detail. The P/I unit 106 may include a ROM (read only memory) (not shown), a RAM (random access memory) (not shown), and a one chip state CPU (central processing unit) 600 connected to both the ROM and the RAM through a local bus line 601. Further, a dual port memory 602, a plurality of registers 603, 604, 605, and 606, an I/O (input and output) port 607, and a device code setting switch 608 connected to the I/O port 607 are provided therein.

The CPU 600 and the CPU 500 disposed in the P/I unit 106 and the image forming apparatus respectively may access the dual port memory 602 to write and read data. The dual port memory 602 may store text data to be communicated between the P/I unit 106 and a PPC controller 511 of the image forming apparatuses 101–102. The plurality of registers 603, 604, 605 and 606 may be used while the text data is communicated between the P/I unit 106 and the PPC controller 511.

The device code setting switch 608 may set a plurality of different device codes to identify the image forming apparatuses 101–102 respectively. As described earlier, each device code may be used when the data communication apparatus 200 executes the polling or selecting operation. The P/I unit 106 may further include a serial communication control unit 609 connected to the data communication apparatus 200 via a communication line or a P/I unit 106 of another image forming apparatus. The PPC controller 511 may control almost all of the devices illustrated in FIG. 5.

Figure 6:
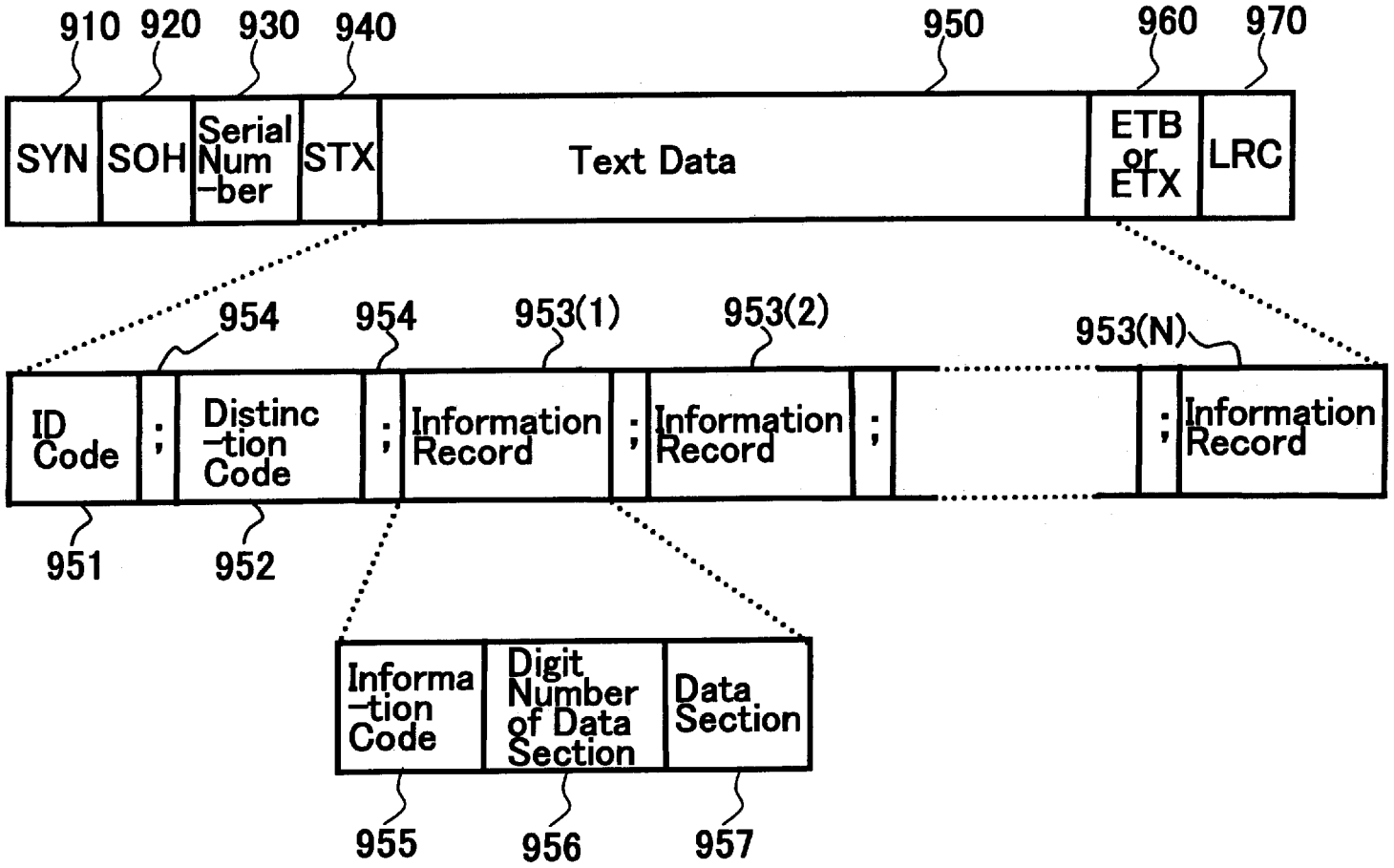
FIG. 6 is a chart that illustrates an example of a structure of text data to be communicated between the central control apparatus and the data communication apparatus illustrated in FIG. 1.

A frame to be communicated among the central control apparatus 260, the data communication apparatus 200, the P/I unit 106, and the control devices of the copiers is now explained referring to FIGS. 6 through 8.

First, a structure of a first type of frame to be communicated between the CCA 260 and the DCA 200 is explained referring to FIG. 6. As illustrated therein, text data 950 may be included in the frame. The text data 950 may be transmitted and received along with data SYN 910, SOH 920, a serial number 930, STX 940, ETB or ETX 960, and LRC 970. Since a plurality of the frames are generally communicated therebetween, a serial number is respectively put thereto. Thus, each sequential number may represent a communication frame number. Further, a number 01 may be put in the first frame, and increased numbers may respectively be put in the following frames. Such numbers may increase until 99, and complete at 00.

The text data may include an ID code 951, a distinction code 952, and an information record 953(1)–(N). The ID code 951 may identify both a data communication apparatus 200 and one of the images forming apparatuses 101–102. The distinction code 952 may include a code for indicating a kind of object of a data communication (hereinafter referred to as a processing code), a sender's code, and a recipient code.

Such a distinction code 952 may be predetermined referring to the table illustrated in FIG. 7. The information record 953 may include an information code 955, a data section 957, and a digit number of a data section 956 indicating a digit number of the data of the data section 957. The information record 953 may be predetermined referring to the table as shown in FIG. 8. A plurality of semicolons 954 as data separators may be respectively inserted among the ID code 951, the distinction code 952, and the plurality of information records 953(1)–953(N).

Figure 9:
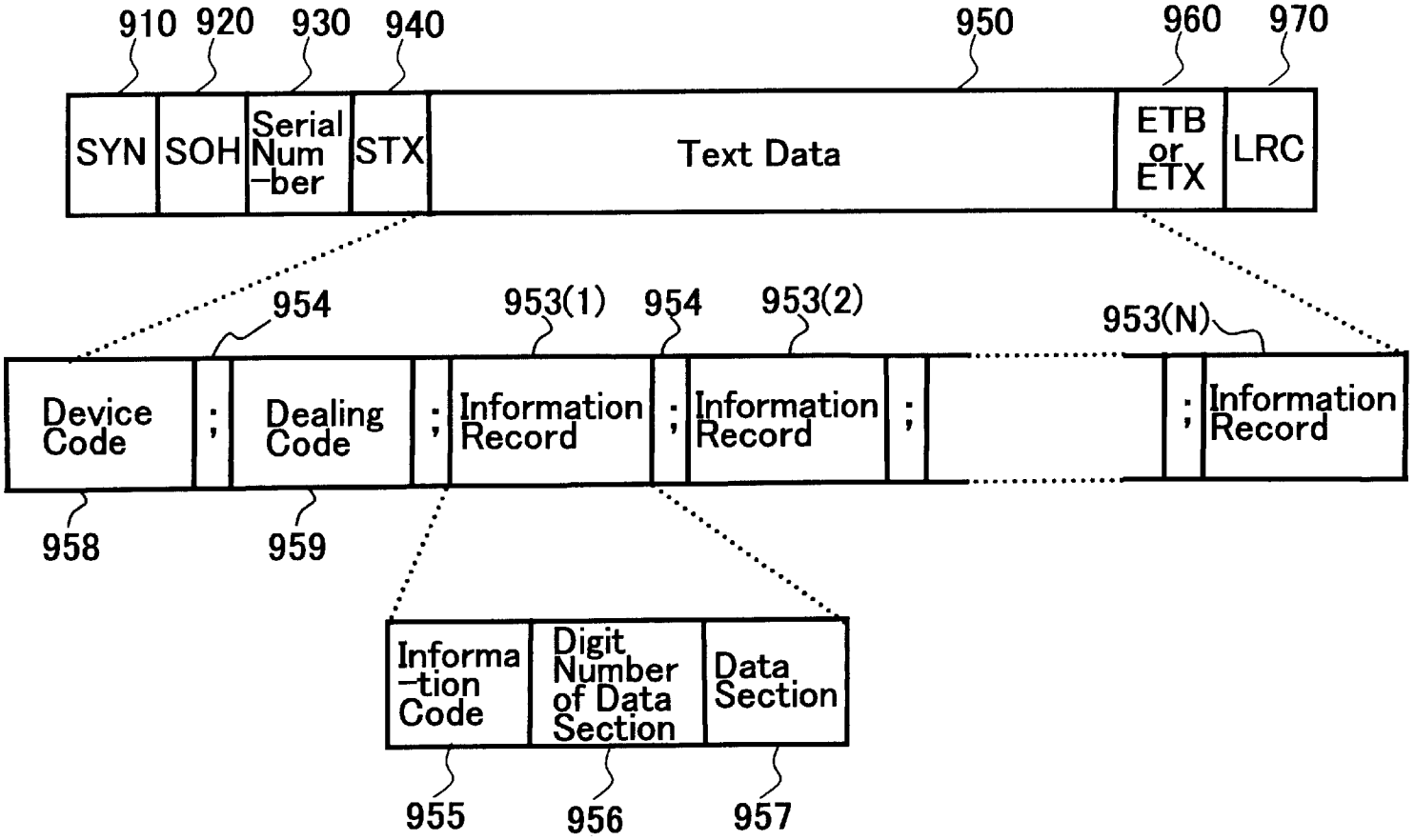
FIG. 9 is a chart that illustrates an example of a structure of text data to be communicated between the personal interface of the image forming apparatus and the data communication apparatus illustrated in FIG. 1.

Hereinbelow, a second type of frame to be communicated between the data communication apparatus 200 and the P/I unit 106 is explained referring to FIG. 9. As illustrated therein, a device code 958 may be included in the text data 950 of the frame. The device code 958 may identify a data-communication-desired image forming apparatus. A plurality of device codes 958 set by the operator using the device code setting switch 608 illustrated in FIG. 5 may have been read from each image forming apparatus 101–102 when the copier group 100 is firstly connected to the DCA 200.

The device codes 958 are stored in the non-volatile RAM 504 of the data communication apparatus 200. The device codes 958 are decoded into fewer or larger digit codes corresponding to a transmitting direction of the frame when data is communicated between the image forming apparatuses 101–102 and the data communication apparatus 200.

The dealing code 959 may be put in the frame and may represent a kind of an object of the data communication as described in the first type of the frame. The processing code may be constructed by deleting both sender's and recipient codes from the distinction code 952 illustrated in FIG. 6. Such codes may be selectively put in and deleted therefrom depending upon a transmitting direction of the frame.

Hereinbelow, a third type of frame to be communicated between the P/I unit 106 and the PPC controller 511 (including the CPU 500, the ROM 502, the A/D converter 507, and the real time clock 510) is explained referring to FIG. 10. The third type of frame may be constructed by deleting the header, the device code, and a parity portion generally used in the second type of the frame shown in FIG. 9.

Functions of the image forming apparatus supervising system are now explained. The system has mainly three basic functions as described below. As a first function, the central control apparatus 260 may transfer instruction data to the image forming apparatus group 100 by a selecting operation. As a second function, the image forming apparatuses 101–102 may transfer request data, alarm data, and so on, to the central control apparatus 260 through the data communication apparatus 200 during a polling operation. As a third function, the data communication apparatus 200 may uniquely control each image forming apparatus 101–102 by selecting operations thereof. The selecting operation may indicate that a prescribed image forming apparatus is selected and data communications are executed to and from the selected image forming apparatus.

According to the first function, the below described data communication controls are executed.

First, a number of a total copy count value counted by the total copy counter, a number of a copy count value for each of copysheet cassettes employed in the image forming apparatus, and a number of a total copy count value for each of different sized copysheets are read for controlling the image forming apparatuses 101–102 by the CCA 260. Further, the copy counter may be reset by the CCA 260. Further, a number of total times mis-feeding occurs on any copysheet feeding path, a number of mis-feeding times per each different sized copysheet, and a number of times mis-feeding occurs at a prescribed position on a copysheet feeding path are also read for the same purpose as mentioned above.

Secondly, a prescribed amount of a control voltage, a current, a resistance, and a process timing to be set to an image formation unit of a selected image forming apparatus 101–102 are selectively read and set.

Thirdly, messages are transmitted from the CCA 260 by return when a request data or an alarm data generated by the selected image forming apparatus is transmitted to the central control apparatus 260.

Figure 11:
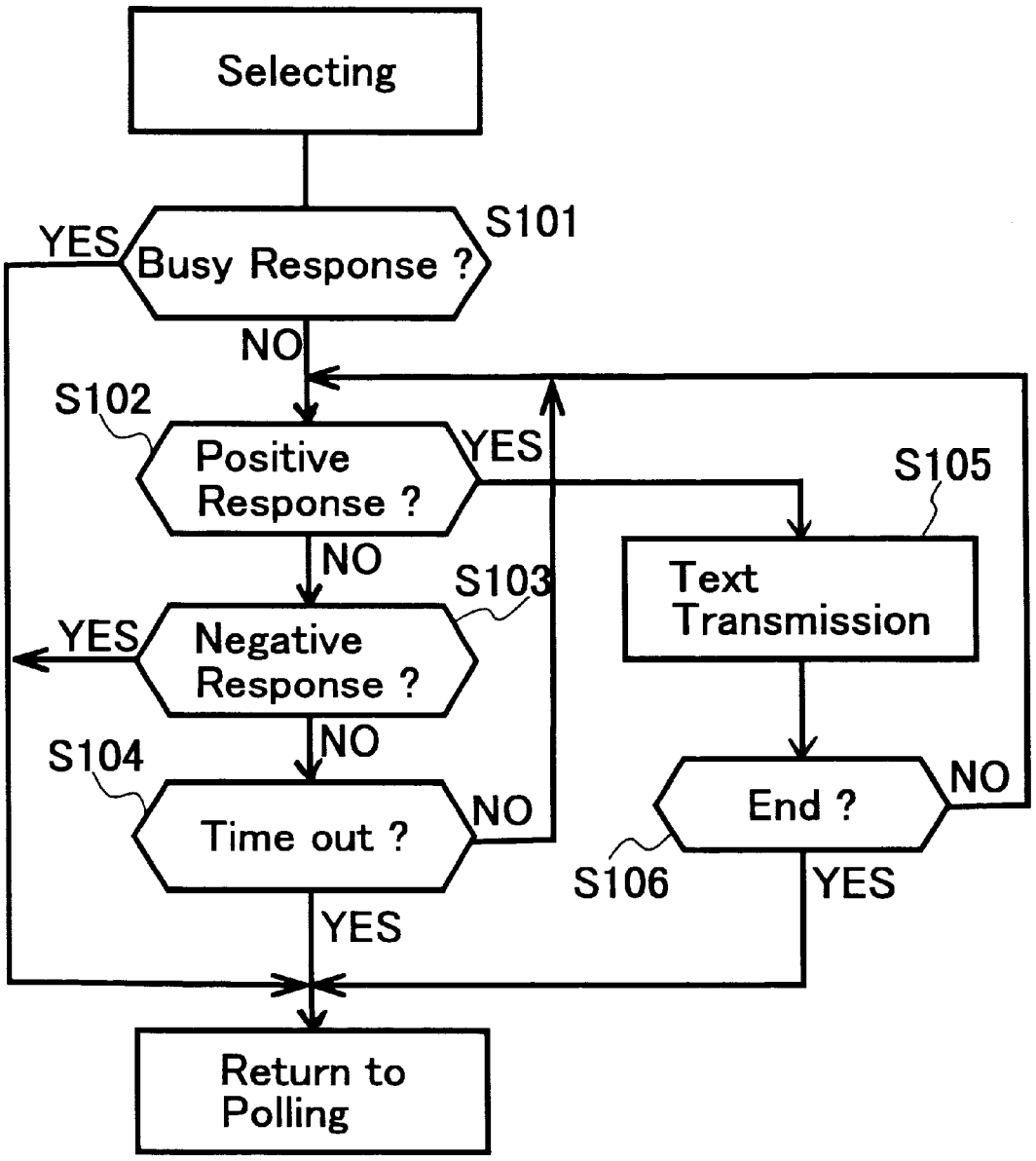
FIG. 11 is a flow chart that illustrates an example of a selecting operation to be executed by the data communication apparatus illustrated in FIG. 1.

The selecting operation is illustrated in detail referring to FIG. 11. As illustrated therein, a prescribed image forming apparatus of group 100 is selected by the central control apparatus 260 firstly. Then, the data communication from the central control apparatus 260 to the selected image forming apparatus is started. The data communication apparatus 200 may output data including a prescribed code indicating a selecting operation, and a prescribed device code to the image forming apparatuses 101–102 on a serial data communication interface RS-485. A prescribed image forming apparatus may recognize being selected by comparing the device code added to the selecting code transmitted from the data communication apparatus 200 with its own device code allocated thereto.

The selected image forming apparatus may output a busy response signal having at least a prescribed code or codes to the data communication apparatus 200 in step S101, if the selected image forming apparatus has data to be transmitted to the central control apparatus 260. The data communication apparatus 200 may then stop the selecting operation and start a polling operation described later in detail.

If the determination in step S101 is negative (i.e., No), the selected image forming apparatus may then determine if it is possible to respond to the selecting in step S102.

A selected image forming apparatus may output a positive response when it has no data to be transmitted therein. Thus, the selected image forming apparatus may output a positive response signal to the data communication apparatus 200 so as to start data communications between the data communication apparatus 200 and itself in steps S105 and S106, if the determination in step 102 is positive (i.e., Yes). The positive response signal may include at least a prescribed code or codes.

The selected image forming apparatus may output a negative response signal, if it is impossible to respond in step S103. The negative response signal may also include at least a prescribed code or codes. The negative response may stop the selecting operation of the data communication apparatus 200.

The data communication apparatus 200 may also stop the selecting operation when the selected image forming apparatus outputs neither a positive response signal nor a negative response signal within a prescribed time period after a start of the selecting operation thereto, i.e. if a time out occurs in step S104 (i.e., Yes in step S104). The selected image forming apparatus generally outputs neither a positive response signal nor a negative response signal when electrical power is not being supplied to the selected image forming apparatus. Then, a polling operation may be started for a next image forming apparatus.

Hereinbelow, the second function of the system is explained in detail. The below-described data communication is executed from one of the image forming apparatuses 101–102 to the central control apparatus 260 or the data communication apparatus 200 during a polling operation.

First, an urgent data communication may be executed from the image forming apparatus to the central control apparatus 260 via the data communication apparatus 200 in order to report that some possibility of an accident causing the image forming apparatus to be inoperative has arisen in the image forming apparatus.

Secondly, an urgent data communication may be executed in a same manner as mentioned above, when an operator inputs a signal indicative of a request for a new consumable article or a repair request from the image forming apparatus.

Thirdly, an urgent data communications may be executed in the same manner as mentioned above in order to report a status that a value of a counter disposed in the image forming apparatus is just about at a prescribed level.

Fourthly, a non-urgent data communication may be executed at a designated time in a day from the image forming apparatus to the central control apparatus 260 via the data communication apparatus 200. For example, when some possibility of an accident that does not interfere with a copying operation has arisen in an image forming apparatus, the image forming apparatus may non-urgently inform the central control apparatus 260 of such possibility.

Further, the central control apparatus 260 may be informed of a status that a value of the copy counter is just about at a predetermined level. Further, when an image forming device has been used a predetermined number of times which corresponds to a lifetime thereof, or a sensor reaches a predetermined maximum durable level at which the sensor does not function, that information may be reported in the same manner. The central control apparatus 260 may set the above-described designated times, and that data may be stored in the data communication apparatus 200.

However, a data communication may be executed urgently, if an image forming device has been used a predetermined number of times before the predetermined time of the day in this case.

Fifthly, elapsing of a predetermined time period starting from a first usage of an image forming apparatus is communicated not urgently. The data communication may be executed at the designated time in the day. The polling operation is generally executed every time from the data communication apparatus 200 to each image forming apparatus 101–102 so that the data communication apparatus 200 can receive data to be transmitted therefrom generated by each image forming apparatus 101–102 and transfer the data to the central control apparatus 260.

Figure 12:
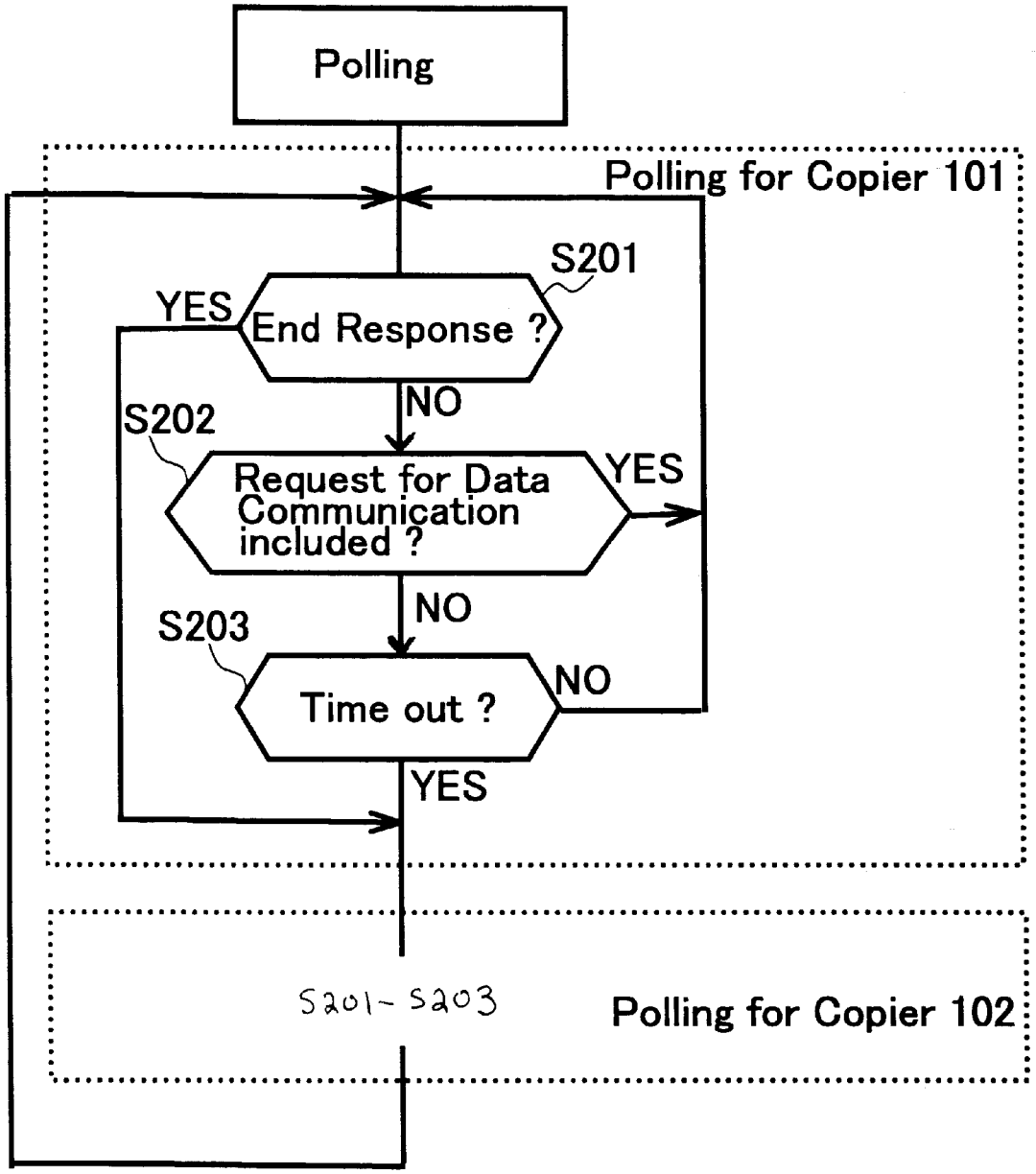
FIG. 12 is a flow chart that illustrates an example of a polling operation to be executed by the data communication apparatus illustrated in FIG. 1.

The polling operation from the data communication apparatus 200 is illustrated in detail in FIG. 12. As shown in FIG. 12, the polling may be executed by designating one of the image forming apparatuses 101–102 in turn, and determining if each image forming apparatus has communication data to be transmitted to the central control apparatus 260. When the polling operation is executed, the data communication apparatus 200 may transmit a prescribed code data indicating a polling operation and a device code through a serial data communication interface RS-485 standard, as an example.

Each image forming apparatus may compare its own device code allocated thereto with the above-described device code during the polling operation. One of the image forming apparatuses 101–102 may recognize being designated for the polling operation, by determining that its own device code accords with the device code transmitted from the data communication apparatus 200. Then, the designated image forming apparatus may start outputting a code signal representing a consumable request, as an example, to the central control apparatus 260 when having communication data to be transmitted therein.

Further, the designated image forming apparatus may stop such a data communication when having no communication data therein in step S201, i.e., YES in step S210, or when having completed the data communication by outputting a prescribed ending code in steps S201 (YES) and S202 (YES). To continue the polling operation, the data communication apparatus 200 may designate a next image forming apparatus, e.g. copier 102, upon receiving the ending code in step S201. Further, the data communication apparatus 200 may stop the polling operation when a prescribed time has elapsed after the polling operation starts with respect to the designated image forming apparatus in step S203, i.e., YES indicating a time out in step S203. For example, the data communication apparatus 200 may stop the polling operation when the designated image forming apparatus does not return any correspondence, or it outputs the ending code due to turning electrical power OFF for the image forming apparatus.

The polling operation may be continuously executed to each image forming apparatus in a prescribed sequence unless the selecting operation, which has a priority over the polling operation, is started.

Hereinbelow, the third function of the system executed only by the data communication apparatus 200 is explained in detail. The data communication apparatus 200 may read a number of total copy count values from a designated image forming apparatus.

Further, the data communication apparatus 200 may transmit communication data, indicating whether communication of data from an image forming apparatus to the CCA 260 is valid, in response to the data communication. The above-described reading of the number of the total copy count value may be executed at a predetermined time once a day, as an example at noon.

However, if an electrical power source to be supplied to the image forming apparatus is turned OFF at the time, such reading may be executed after the electrical power source is supplied again to the designated image forming apparatus.

The data communication apparatus 200 may have first and second total counter memories therein for respectively storing data of total copy count values. Such numbers of total copy count values are read by a selecting operation as described earlier, and are stored in the first total copy counter memory.

The data of the number of the total copy count value stored in the first total counter memory may be renewed when a new number of total copy count values is read and stored therein on a later day. The new number can not be read and stored in the first total counter memory, if the designated image forming apparatus is not used until the selected day, for example Sunday. This results because the system is generally not used on the day.

The data lately stored in the first total copy counter memory may be copied to the second total copy counter memory at a predetermined time on a selected day once in a week, as an example. The central control apparatus 260 may lastly set the time and the day. That data may be stored in a non-volatile RAM provided in the data communication apparatus 200.

The data communication apparatus 200 may transmit data, indicating the number of the total copy count value stored in the second total copy counter memory, to the central control apparatus 260. The transmission of the data may be executed in two different ways as described below.

First, the central control apparatus 260 may access the data communication apparatus 200 to read the data at a predetermined time of a predetermined day after the data of the number has been copied to the second total counter memory from the first total counter memory.

Second, the data communication apparatus 200 may transmit data of the number at a predetermined time of a day after the data thereof has been copied to the second total counter memory to the central control apparatus 260 by automatically dialing a telephone number of the central control apparatus 260. Data of the time period for calling may also have been previously generated by the central control apparatus 260 and stored in the non-volatile RAM of the data communication apparatus 200.

Further, the data communication apparatus 200 may have a plurality of other pairs of the first and second memories. Such memories may respectively be used for different copy modes, as an example a mono-color copying mode, a full-color copying mode, an application copying mode, such as a facsimile mode, a printer mode, and so on. Data of a number of total copy count values in each of the different copy modes can be stored in the first total copy counter memory and then copied to the second total counter memory in the same manner as mentioned above.

Figure 13:
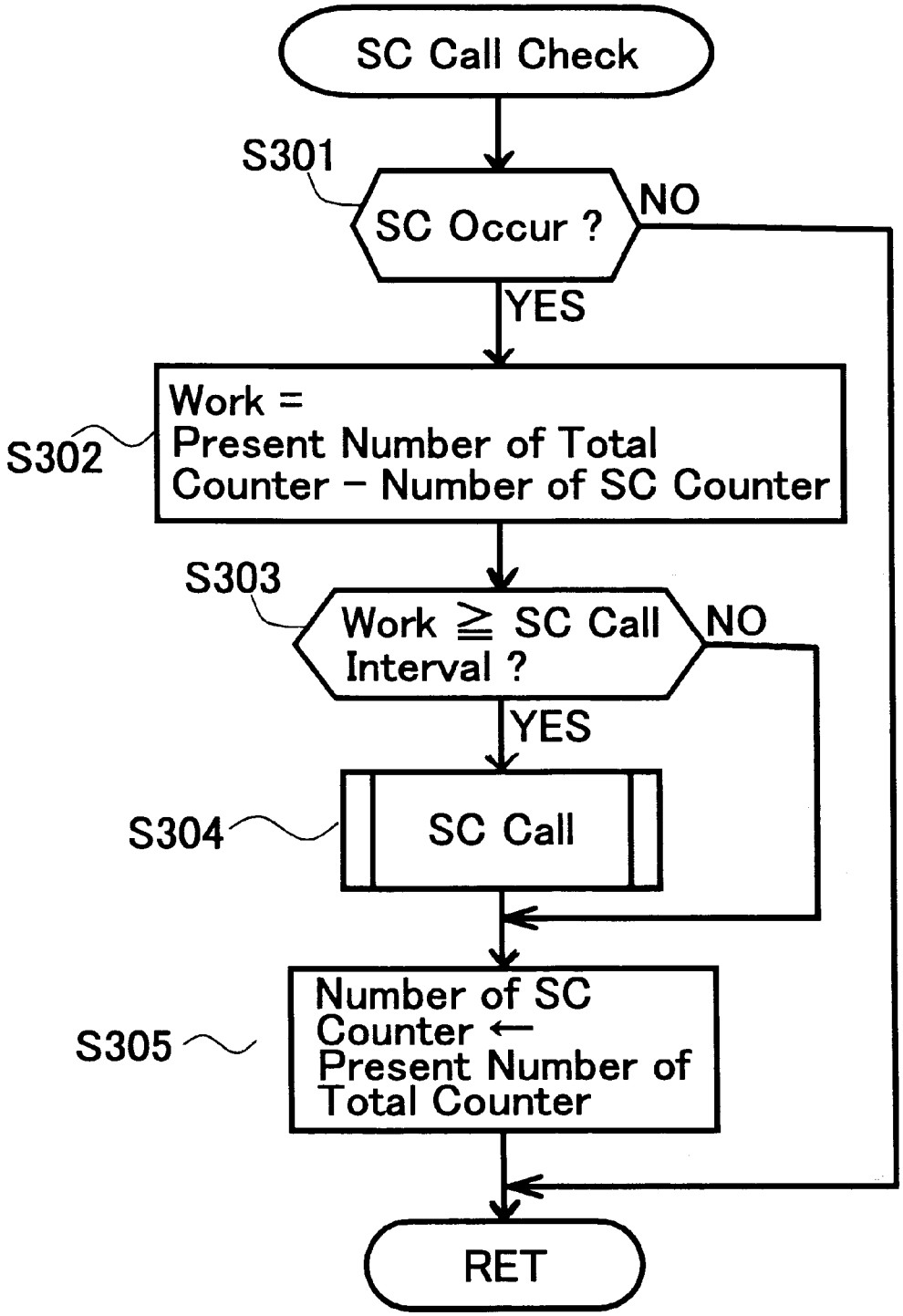
FIG. 13 is a flowchart that illustrates a checking operation of a SC, which is executed when a problem to be reported to the central control apparatus as a SC occurs in the image forming apparatus.

An example of a SC call executing operation is now explained referring to FIGS. 13 through 15. As illustrated in FIG. 13, if a SC has occurred in an image forming apparatus is first determined in step S301. A number of copy count values counted until a last SC call was made (hereinafter referred to as a last SC count value) by a total copy counter (not shown) disposed in the image forming apparatus may have been stored in a SC counter (not shown) before executing step S301.

If the determination is positive in step S301 (i.e., Yes a SC occurs), the number of the last SC count value may be subtracted from that of the present total copy count value continuously counted after the lastly made SC call by the total copy counter in step S302. The number of the copy count value obtained by the above-mentioned calculation is set to a "work" as a variable, so that the work may be compared with a prescribed SC call interval in step S303.

The SC call interval is employed so that a new SC call is inhibited from being made to the central control apparatus 260 during the SC call interval even if a new SC occurs in an image forming apparatus within the interval. This results because such a new SC call is regarded as erroneous. The SC call interval may be determined at a predetermined level of a copy count value, which is larger than a number of copysheets to be made during a detection of the SC. Thus, if the work exceeds the SC call interval in step S303, a SC call may be made to the central control apparatus 260 from the image forming apparatus.

At the same time, a number of total copy count value may be set to the SC counter having a number of the last SC count value in step S305, so that a next comparison between a number of present total copy count value and that of a last SC count value can be performed when a next SC occurs.

If the work value is below the SC call interval, the SC is not made to the central control apparatus 260 as such a new SC call may be regarded as erroneously occurring in the image forming apparatus. Further, the number of the present total copy count value may be set to the SC counter having a number of a last SC count value for a purpose of a new comparison as mentioned above in step S305. Thus, if a difference in a number of copy count values therebetween is more than the predetermined level, namely a problem (SC) continuously occurs in the image forming apparatus more than the predetermined level, the problem may be reported to the central control apparatus 260 as a SC call at a first time. Accordingly, an erroneous detection of a SC by an image forming apparatus and reporting thereof to the central control apparatus 260 can be suppressed.

The SC call interval used in step S303 may be preset at a predetermined amount as mentioned earlier. The SC call interval, however, can be changeable in accordance with a SC call kind, for example a SC call generating condition as illustrated in FIG. 14.

FIG. 14 illustrates an example of a table showing relations among a SC number allocated to each SC call kind, a name of the SC call number, and a SC detecting condition. SC may occur only when a problem occurring in an image forming apparatus exceeds the SC detecting condition.

FIG. 15 illustrates an example of a SC call interval table illustrating a relation between the SC number and a SC call interval. The SC call interval may be obtained referring to the SC call interval table corresponding to the SC number. As illustrated in FIG. 15, the SC call number may be allocated to each SC kind as mentioned later. Thus, if a SC 101 occurs, as an example, and contents of a work value includes an amount of copy count values greater than five, the SC call may be executed to the central control apparatus 260. This results because a SC call interval indicates an amount of five copy count value as illustrated in FIG. 15, and the work value exceeds the SC call interval.

If a SC 201 occurs in an image forming apparatus, a SC call may be always executed, because, as illustrated in FIG. 15, a SC call interval indicates a zero copy count value, and contents of the work value always exceed zero (copy count). Thus, even if a plurality of SCs continuously occur during a short time period in an image forming apparatus, all of the SCs are reported to the central control apparatus 260 in this case. A SC call interval of zero may be utilized for SC's occurring in the fixing device, because contents of the SC's are generally related to dangerous matters.

According to the above-mentioned embodiment, any kind of the SC can be avoided from being erroneously reported to the central control apparatus 260 by employing a prescribed SC call interval.

Numerous additional modifications and variants of the present invention are possible in light of the above teachings. It is therefore to be understood that within the scope of the appended claims, the present invention may be practiced other than as specifically described therein.

This document is based on the Japanese patent applications No. 10-280072 and No. 11-262698, respectively filed in the Japanese patent office on Oct. 1, 1998, and Sep. 16, 1999, and the entire contents of each of which are hereby incorporated herein by reference.

What is claimed is:

1. An image forming apparatus supervising system, comprising:

a central control apparatus;

a data communication line connected to the central control apparatus;

at least one image forming apparatus connected to the central control apparatus through the data communication line, said at least one image forming apparatus being supervised by the central control apparatus;

a problem detecting device configured to detect a problem having occurred in the at least one image forming apparatus;

a first copysheet number storing device configured to store a total number of copysheets copied by said at least one image forming apparatus before a current occurrence of the problem;

a second copysheet number storing device configured to store a SC (service call) number of copysheets having been copied by said at least one image forming apparatus before a last occurrence of the problem; and a problem data reporting device configured to report the problem to said central control apparatus from the at least one image forming apparatus, wherein said problem is reported only when a difference between said total number and the SC number exceeds a predetermined level.

2. An image forming apparatus supervising system as claimed in claim 1, wherein said number of total copysheets stored in the first copysheet number storing device is copied to the second copysheet number storing device when the current occurrence of the present problem occurs.

3. An image forming apparatus supervising system as claimed in claim 1, wherein said predetermined level is predetermined corresponding to a kind of the problem.

4. An image forming apparatus supervising system as claimed in claim 1, wherein said predetermined level is changeable.

5. An image forming apparatus supervising system as claimed in claim 1, wherein said problem is related to a service person call for calling a service person to a user of the at least one image forming apparatus.

6. A method for supervising at least one image forming apparatus, comprising the steps of:

storing a SC (service call) number of copysheets having been copied before a last occurrence of a problem in the at least one image forming apparatus;

storing a total number of copysheets copied by the at least one image forming apparatus before a current occurrence of the problem;

detecting the problem having occurred in the at least one image forming apparatus;

comparing the total number and the SC number thereof; and, reporting the problem only when a difference between said total number and the SC number exceeds a predetermined level.

7. A method as claimed in claim 6, further comprising the step of:

copying said number of total copysheets stored in the first copysheet number storing device to the second copysheet number storing device when the current occurrence of the problem occurs.

8. A supervising system, comprising:

means for forming images;

central control means for controlling the image forming means;

data communication means for communicating data from the image forming means to the central control means;

means for detecting a problem occurring in the image forming means;

means for storing a total number of copysheets having been copied by said image forming means before a current occurrence of the problem;

means for storing a SC number of copysheets having been copied by said image forming means before a last occurrence of the problem; and means for reporting the problem to said central control means from the image forming means, wherein said problem is reported only when a difference between said total number and the SC number exceeds a predetermined level.

9. A supervising system as claimed in claim 8, wherein said number of total copysheets stored in the first copysheet number storing means is copied to the second copysheet number storing means when the current occurrence of the problem occurs.

10. A supervising system as claimed in claim 8, wherein said predetermined level is predetermined corresponding to a kind of the problem.

11. A supervising system as claimed in claim 8, wherein said predetermined level is changeable.

* * * * *